United States Patent [19]

Sternlieb

[11] Patent Number: 5,019,445

[45] Date of Patent: May 28, 1991

[54] WHITE BLACKOUT FABRIC

[75] Inventor: Herschel Sternlieb, Brunswick, Me.

[73] Assignee: Charles Samelson Co., New York, N.Y.

[21] Appl. No.: 542,014

[22] Filed: Jun. 22, 1990

Related U.S. Application Data

[63] Continuation-in-part of Ser. No. 362,084, Jun. 5, 1989, abandoned, which is a continuation-in-part of Ser. No. 233,013, Aug. 17, 1988, abandoned.

[51] Int. Cl.[5] ..... B32B 5/16; D02G 3/00

[52] U.S. Cl. ..... 428/323; 428/221; 428/224; 428/372; 428/373; 428/374; 428/379; 428/389; 428/395

[58] Field of Search ..... 428/364, 373, 374, 375, 428/395, 372, 368, 296, 221, 224, 323, 240, 379, 389

[56] References Cited

U.S. PATENT DOCUMENTS

| | | | |
|---|---|---|---|
| 2,932,079 | 4/1960 | Dietzsch et al. | 428/393 X |
| 3,531,368 | 9/1970 | Okamoto et al. | 428/376 X |
| 3,551,279 | 12/1970 | Ando et al. | 428/373 X |
| 3,616,183 | 10/1971 | Brayford et al. | 428/373 |
| 3,718,534 | 2/1973 | Okamoto et al. | 428/397 |
| 3,803,534 | 2/1973 | Hull | 428/373 |
| 4,129,677 | 12/1978 | Boe | 428/397 X |
| 4,207,376 | 6/1980 | Nagayasu et al. | 428/397 X |
| 4,756,969 | 7/1988 | Takeda | 428/397 |

*Primary Examiner*—Lorraine T. Kendell

*Attorney, Agent, or Firm*—Cobrin, Feingertz & Gittes

[57] ABSTRACT

A white blackout fiber comprising a core, a sheath, said sheath surrounding said core, said core including a light blocking substance therein that substantially prevents the transmission of light therethrough, the light blocking substance being in an amount equal to 0.005–0.01 weight % of the core, a whitening agent in the core in an amount equal to 3–10% of the weight of the core, and a whitening agent in the sheath in an amount equal to approximately 0.0–4.0 weight % of the sheath.

10 Claims, 1 Drawing Sheet

WHITE BLACKOUT FABRIC

CROSS REFERENCE TO RELATED APPLICATIONS

This application is a continuation-in-part of my copending application Ser. No. 362,084 filed Jun. 5, 1989 for WHITE BLACKOUT FABRIC, and now abandoned; which, in turn, is a continuation-in-part of my earlier application Ser. No. 233,013 filed Aug. 17, 1988, and now abandoned.

BACKGROUND OF THE INVENTION

This invention relates generally to fabrics, and more particularly, is directed to a white blackout drapery fabric.

Totally opaque fabrics used primarily for completely darkening or blacking out a window are well known in the art. Basically, such blackout fabrics are commercially manufactured according to one of two methods.

According to the first method, a fabric is backed with a first coat of white acrylic foam, followed by a second coat of an acrylic foam having an opaque color, and finally, by a third coat of white acrylic foam. In accordance with the second known method, a thin vinyl or polyester sheeting having a white color is laminated to the fabric, followed by a second thin vinyl or polyester sheeting having an opaque color which is laminated thereto, and finally, by a third thin vinyl or polyester sheeting having a white color that is also laminated thereto.

However, the blackout fabrics created by these known methods present numerous disadvantages. Specifically, such blackout fabrics are bulky and stiff. In addition, such blackout fabrics drape poorly and are difficult to launder. Still further, such blackout fabrics have a tendency to come apart or delaminate. It is also difficult to make such blackout fabrics fire retardant. Further, it is difficult to stitch such fabrics, and there is a high cost of production of such blackout fabrics.

It has been proposed that a blackout fabric without the aforementioned drawbacks can be made from yarns comprised of core and sheath components in which the core components have a black color and the sheath components have a white color. However, the black core components tend to show through, producing a black or gray appearance, thereby rendering the blackout fabric unsatisfactory from an aesthetic viewpoint.

The use of sheath and core components in fibers is taught generally in U.S. Pat. Nos. 3,616,167 to Gosden; 3,700,544 to Matsui; 4,075,378 to Anton et al; 3,316,336 to Smith; 2,932,079 to Horn et al; and 4,059,949 to Lee, the entire disclosures of which are incorporated herein by reference.

As an aside, it is desirable in many instances to reduce or prevent the build-up of static electricity in fabrics. Accordingly, it is known to use core components containing carbon black to construct core and sheath fibers. Such components function to discharge static electricity build-up, and have particular utility incertain textile products, such as carpets. However, a large amount of carbon black is required to achieve the desired electrical properties so that the fabric will sufficiently discharge static electricity. Accordingly, such fibers tend to be too dark, and therefore, the final product tends to be unsatisfactory from an aesthetic viewpoint. The static discharging fibers are used in blends with regular white fibers to minimize their blackness, i.e., are usually in a quantity of 1% or less.

In view of this latter problem, various methods have been proposed to inhibit the blackness of the fibers. For example, one proposal has been to make the core in multi-faceted configurations so that light is better deflected. In this regard, U.S. Pat. No. 3,968,307 to Matsui et al discloses a multi-component mixed filament in which at least two spinning materials having poor affinity are mixed in a unitary filament in a nebular configuration. The patent teaches that, by using fibers composed of polyester and polyamide, the filament itself is opaque since polyamide and polyester have different refractive indexes. However, the opacity is not sufficient to make a fiber which has total blackout properties. Accordingly, light is reflected irregularly due to the nebular configuration and the filament is delustered.

Another proposal has been to add $TiO_2$ or other whitening agents to the sheath components. However, in all such cases, the final product must contain more than 50% sheath components and these fibers must be of a heavy duty, for example, greater than 15 denier. As such, such fibers are too stiff, and therefore, cannot be used with a standard drapery or with apparel.

An example of such core and sheath components is disclosed in U.S. Pat. No. 3,803,453 to Hull, the entire disclosure of which is incorporated herein by reference. Specifically, it is taught in this patent to use core and sheath components to reduce static electricity by dispersing an electrically conductive carbon black in a thermoplastic synthetic polymer, with the sheath comprising at least 50% of the filament cross-sectional area. In addition, $TiO_2$ is used with the sheath components. However, with so much carbon black the fiber is essentially black. It is taught that the denier of the filaments should be lower than 50 and preferably less than 25 dpf. However, the lowest denier of the components taught in any example of the patent is 17.2 in Example V, with the denier being as high as 110.6 in Table 3 of the patent. Accordingly, as discussed above, such fibers are too stiff and could not be used with a standard drapery.

U.S. Pat. No. 4,216,264 to Naruse et al, the entire disclosure of which is incorporated herein by reference, discloses a similar arrangement of using carbon black and $TiO_2$, for use with core and sheath components but because of the relative proportions results in a black fiber.

U.S. Pat. No. 3,531,368 to Okamoto et al, the entire disclosure of which is incorporated herein by reference, discloses, in Example IV thereof, the use of two polyethylene terephthalates having an intrinsic viscosity of 0.68 and 0.50, respectively, which are used as the polymers to make up a very fine filament part, in which the first polyethylene terephthalate contains 0.05% of $TiO_2$ and 0.55% of carbon black, and the second polyethylene terephthalate has a high brilliancy. The drawn yarn consists of 16 filaments, each of which is 3.0 denier. The polyethylene terephthalate containing carbon black is uniformly dispersed in the polyethylene terephthalate having a brilliancy when the filament is viewed in cross-section. However, the filament is deep black in color and has a brilliancy, which is undesirable for producing a white blackout fabric.

Other references which are less relevant than those discussed above are U.S. Pat. Nos. 3,051,545 to Media; 2,880,056 to Carr et al which discloses synthetic components having a natural crimp; and 3,249,669 to Jamieson.

A further drawback with prior art bi-component fibers is that such fibers, by themselves, cannot be used to make a fabric because of their blackness. As a consequence of this, a fabric made with prior art bi-component fibers has generally been blended with other fibers to give the fabric a whiteness.

OBJECTS AND SUMMARY OF THE INVENTION

Accordingly, it is an object of the present invention to provide a blackout fabric that overcomes the aforementioned problems.

It is another object of the present invention to provide a blackout fabric made substantially from bi-component fiber having a core surrounded by a sheath.

It is still another object of the present invention to provide a blackout fabric that is totally opaque to light.

It is yet another object of the present invention to provide a blackout fabric that is aesthetically pleasing.

It is a further object of the present invention to provide a fiber having a core surrounded by a sheath in which the core is sufficiently dark to prevent the transmission of light therethrough and the sheath is sufficiently opaque to prevent viewing of the darker core.

It is a still further object of the present invention to provide a blackout fabric having particular utility with drapery linings, printed and solid color hotel and motel draperies, theatre curtains, and woven and non-woven vertical blinds.

It is a yet further object of the present invention to provide a blackout fabric that presents a white, rather than gray or black, appearance.

It is another object of the present invention to provide a blackout fiber that can be used with fabrics that are woven, knit, stitch bonded, needled, wet laid, dry laid, spun bonded and spun laced.

It is still another object of the present invention to provide a blackout fabric that is soft.

It is yet another object of the present invention to provide a blackout fabric that can be easily draped.

It is a further object of the present invention to provide a blackout fabric that can be dyed and printed on.

In accordance with an aspect of the present invention, a white blackout fabric consists essentially of fibers. Each fiber is formed from a core having a light blocking substance therein that substantially prevents the transmission of light therethrough; and a sheath which surrounds the core and has a whitening agent therein.

In accordance with another aspect of the present invention, a white blackout yarn includes a plurality of fibers with each fiber including a core having a light blocking substance therein that substantially prevents the transmission of light therethrough, the light blocking substance being present in an amount equal to approximately 0.005–0.01 weight % of the core and a whitening agent in the core from 3% to 10% of the weight of the core; and a sheath surrounding the core and having a whitening agent therein, the whitening agent being present in an amount equal to approximately 0–4.0 weight % of the sheath.

The above and other objects, features and advantages of the present invention will become readily apparent from the following detailed description.

DETAILED DESCRIPTION OF PREFERRED EMBODIMENTS

Figure 1:
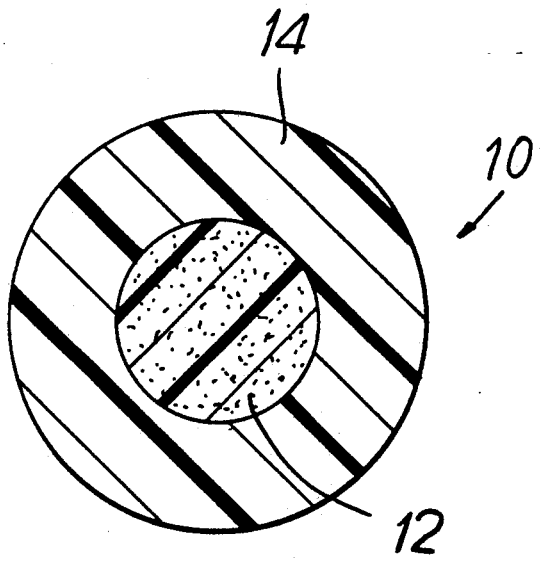
FIG. 1 is a cross-section of a fiber according to the present invention.

In accordance with the present invention, a white blackout fabric that is totally opaque to light is constructed from fibers, with each fiber being made from a core which is surrounded by a sheath. Specifically, the present invention uses the basic technology of a fabric being made from fibers with each fiber having a core that contains carbon black and/or other suitable light blocking substances and a whitening agent, and a sheath that surrounds the core with each sheath containing $TiO_2$ and/or other suitable whitening agents. Each fiber has approximately a 3 denier weight with an appropriate staple length so as to provide bi-component yarns of the desired size. Preferably, an F.R. (fire retardant) polyester component is used, although this is not essential to the present invention. For example, other components such as standard polyesters, polyamides or chemical substances suitable for spinning into fibers. In FIG. 1 a fiber 10 is shown having a core 12 surrounded by a sheath 14.

Thus, by minimizing the amount of carbon black in the core and maximizing the amount of $TiO_2$ in the core and sheath of each fiber, a white yarn that is totally opaque can be produced according to the present invention. In accordance with the present invention, and based on a 50/50 sheath/core weight ratio for each fiber, approximately 0.005–0.01 weight % of carbon black is used, based on the weight of the polyester in the core, and approximately 0–4.0 weight % of $TiO_2$ is used, based on the weight of the polyester in the sheath, with each sheath surrounding a core. The $TiO_2$ in the core is 3–10% weight.

These yarns can be achieved in any number of suitable ways. For example, such totally opaque, white yarns can be made by altering the percentage composition of a core and its surrounding sheath. Alternatively, such yarns can be made by altering the amount of carbon black in the core and/or altering the amount of $TiO_2$ in the sheath keeping in mind that each core is surrounded by a sheath. Still further, such yarns can be made by maximizing the crimp in a paired core and sheath of a fiber and/or altering the geometry thereof to maximize light reflectance and/or light diffusion.

In any case, the crimp and the finish on the fibers should be satisfactory for carding the same into webs that can be cross lapped and/or carded into a silver so that the silver can be spun on any conventional yarn making system.

It will be appreciated that the present invention differs from known fabrics that use carbon black primarily to discharge static electricity and not primarily for blackout. In such fabrics, a maximum amount of carbon black is used. Thus, for example, a yarn that is dark gray in color would be produced from a 300 denier yarn incorporating 20 individual strands of uncrimped 50% core and 50% sheath components, fully using the maximum amount of carbon black therein. As a result of the large amount of carbon black used, it is necessary to blend the fibers with white fibers to impart a white appearance. Accordingly, such fibers are primarily used for carpets. The present invention, on the other hand, consists essentially of the core and sheath components, and accordingly, the fabric is produced substantially without blending.

It will be appreciated that other materials other than carbon black and/or $TiO_2$ can be utilized to construct the core and surrounding sheath according to the present invention. However, the basis of the present invention would remain the same, namely that the core would be sufficiently opaque to prevent light transmission through the fabric and the surrounding sheath would be sufficiently white to provide an aesthetically pleasing product and enable the fiber to be processed readily on standard textile equipment.

Further, the core and surrounding sheath according to the present invention can be used to eliminate, or at least substantially diminish, cloudiness that is inherent in all carded webs by utilizing specific percentages of the core and surrounding sheath fibers with regular or standard components.

In order to better understand the present invention, the following specific examples are given in which carbon black and $TiO_2$ are used in the above recited ranges:

EXAMPLE 1

A fabric can be made from 80 ends of 300 denier texturized polyester warp yarn and 90 picks of 20s cotton count yarn made from fibers, each consisting of an opaque core and surrounding sheath woven in a warp sateen configuration and then finished by at least one of the following methods: pre-shrinking, calendering and hydraulically entangling.

EXAMPLE 2

A fabric can be made from 115 ends of 20s cotton count yarn and 70 picks of 20s cotton count yarn, both made from fibers which each consist of an opaque core and surrounding sheath woven in a warp sateen configuration and then finished by at least one of the following methods: pre-shrinking, calendering and hydraulically entangling.

EXAMPLE 3

A fabric can be made from 24 ends of 4s cotton count yarn and 22 picks of 4s cotton count yarn, both made from fibers, each fiber consisting of an opaque core and a surrounding sheath woven in a warp sateen configuration and then finished by at least one of the following methods: pre-shrinking, calendering and hydraulically entangling.

EXAMPLE 4

A fabric can be made from a five ounce per square yard carded web which is hydraulically entangled and calendered.

In a further embodiment of the present invention, titanium dioxide is placed in both the core and surrounding sheath of a fiber. It is known that the addition of titanium dioxide to a fiber, although dulling the fiber, causes the same to be abrasive on both filament extruding and yarn spinning equipment and, above a certain amount, can be so undesirable as to make the fiber unusable in a practical sense.

In accordance with this embodiment of the present invention, titanium dioxide is used in both the core and surrounding sheath of a fiber, with the amount used in the sheath being approximately 0–4% of the weight of the polyester in the sheath. The weight of the carbon black in the core is approximately 0.005–0.01% and the weight of the $TiO_2$ in the core is approximately 4–10%. This provides for dulling the fiber and affords maximum efficiency for yarn spinning and drapability. The total ratio of titanium dioxide to carbon black in both the sheath and the core of a fiber determining the whiteness of the fiber. It has been found that approximately 1,000 parts titanium dioxide in both the sheath and core of a fiber to one part carbon black in the core results in fibers that are commercially acceptable while providing appropriate whiteness. The weight of such a fiber should preferably be in the range of 1.5–8 denier.

A textile structure that lends itself to full coverage can be made opaque by using the aforementioned opaque fiber. This is true, regardless of the manner in which the fabric is formed. Thus, the present invention can be used with fabrics that are woven, knit, stitch bonded, needled, wet laid, dry laid, spun bonded and spun laced.

Thus, the present invention provides a white blackout fabric from fibers, each having a core and sheath, and which is totally opaque to light, while being aesthetically pleasing. Specifically, the core of a fiber is sufficiently dark to prevent the transmission of light therethrough and the surrounding sheath is sufficiently opaque to prevent viewing of the darker core.

The present invention thereby has particular utility with drapery linings, printed and solid color hotel and motel draperies, theatre curtains, and woven and nonwoven vertical blinds. In this manner, the blackout fabric is soft, can be easily draped, and can be dyed and printed on.

Having described a specific preferred embodiment of the invention, it will be appreciated that the present invention is not limited to that precise embodiment, and that various changes and modifications may be effected therein by one of ordinary skill in the art without departing from the scope or spirit of the invention as defined in the appended claims.

What is claimed is:

1. A white blackout fiber consisting essentially of a polymeric core component and a polymeric sheath component, said core component containing a light blocking substance that substantially prevents the transmission of light therethrough and a whitening agent, said sheath component containing a whitening agent therein, said light blocking substance in said core component being 0.005–0.01% of the weight of the core component, said whitening agent being in the core and the sheath component combined in the amount of 3%–10% by weight of the fiber.

2. A white blackout fiber according to claim 1, wherein said sheath and said core have a weight of approximately 3 denier.

3. A white blackout fiber according to claim 1, wherein said sheath and said core are selected from the group consisting essentially of polyesters and polyamides.

4. A white blackout fiber according to claim 1, wherein said light blocking substance is carbon black.

5. A white blackout fiber according to claim 1, wherein said whitening agent is $TiO_2$.

6. A white blackout fabric formed of fibers, said fibers each consisting essentially of a polymeric core component and a polymeric sheath component, said core component containing a light blocking substance that substantially prevents the transmission of light therethrough and a whitening agent, said sheath component containing a whitening agent therein, said light blocking substance in said core component being 0.005–0.01% of the weight of the core component, said whitening agent being in the core and the sheath component combined in the amount of 3%-10% by weight of the fiber.

7. A white blackout fabric according to claim 6, wherein the sheath and core of each fiber forming said fabric have a weight of approximately 3 denier.

8. A white blackout fabric according to claim 6, wherein the core and sheath of each fiber are selected from the group consisting essentially of polyesters and polyamides.

9. A white blackout fabric according to claim 6, wherein said light blocking substance is carbon black.

10. A white blackout fabric according to claim 6, wherein said whitening agent is $TiO_2$.

* * * * *